343-700 MS AU 256 E
4/24/79 OR 4,151,531

United States Patent [19] [11] 4,151,531
Kaloi [45] Apr. 24, 1979

[54] ASYMMETRICALLY FED TWIN ELECTRIC MICROSTRIP DIPOLE ANTENNAS

[75] Inventor: Cyril M. Kaloi, Thousand Oaks, Calif.

[73] Assignee: The United States of America as represented by the Secretary of the Navy, Washington, D.C.

[21] Appl. No.: 847,455

[22] Filed: Oct. 31, 1977

Related U.S. Application Data

[62] Division of Ser. No. 740,690, Nov. 10, 1976, Pat. No. 4,072,954.

[51] Int. Cl.[2] ..... H01Q 1/38; H01Q 21/00; H01Q 1/48

[52] U.S. Cl. ..... 343/700 MS; 343/853; 343/846

[58] Field of Search ..... 343/700 MS, 705, 708, 343/772, 846, 853

[56] References Cited

U.S. PATENT DOCUMENTS

| | | | |
|---|---|---|---|
| 3,757,342 | 9/1973 | Jasik et al. | 343/700 MS |
| 3,972,049 | 7/1976 | Kaloi | 343/700 MS |
| 4,060,810 | 11/1977 | Kerr et al. | 343/725 |
| 4,074,270 | 2/1978 | Kaloi | 343/700 MS |
| 4,089,003 | 5/1978 | Conroy | 343/700 MS |

*Primary Examiner*—Alfred E. Smith
*Assistant Examiner*—Harry E. Barlow
*Attorney, Agent, or Firm*—Richard S. Sciascia; Joseph M. St.Amand

[57] ABSTRACT

Twin electric microstrip dipole antennas consisting of thin electrically conducting rectangular shape elements formed on both sides of a dielectric substrate. In these antennas the element on one side of the substrate is the mirror image of the element on the other side of the substrate. Each of the elements act, in effect as a ground plane for the other. The thickness of the substrate to a large extent determines the bandwidth of the antenna and the length of the conducting elements on both sides of the substrate determines the resonant frequency.

22 Claims, 65 Drawing Figures

ASYMMETRICALLY FED TWIN ELECTRIC MICROSTRIP DIPOLE ANTENNAS

CROSS-REFERENCED U.S. PATENTS AND APPLICATIONS

This is a division of application Ser. No. 740,690 filed Nov. 10, 1976 now U.S. Pat. No. 4,072,954 issued Feb. 7, 1978.

This invention is related to U.S. Pat. No. 3,947,850, issued Mar. 30, 1976 for *NOTCH FED ELECTRIC MICROSTRIP DIPOLE ANTENNA;* U.S. Pat. No. 3,978,488, issued Aug. 31, 1976 for *OFFSET FED ELECTRIC MICROSTRIP DIPOLE ANTENNA;* U.S. Pat. No. 3,972,049, issued July 27, 1976 for *ASYMMETRICALLY FED ELECTRIC MICROSTRIP DIPOLE ANTENNA;* U.S. Pat. No. 3,984,834, issued Oct. 5, 1976 for *DIAGONALLY FED ELECTRIC MICROSTRIP DIPOLE ANTENNA;* and U.S. Pat. No. 3,972,050, issued July 27, 1976, for *END FED ELECTRIC MICROSTRIP QUADRUPOLE ANTENNA;* all by Cyril M. Kaloi and commonly assigned.

This invention is also related to copending U.S. Pat. applications:

- Ser. No. 740,696 now U.S. Pat. No. 4,051,478 for *NOTCHED/DIAGONALLY FED ELECTRIC MICROSTRIP DIPOLE ANTENNA;*
- Ser. No. 740,694 now U.S. Pat. No. 4,083,046 for *ELECTRIC MONOMICROSTRIP DIPOLE ANTENNAS;* and
- Ser. No. 740,692 now U.S. Pat. No. 4,067,016 for *CIRCULARLY POLARIZED ELECTRIC MICROSTRIP ANTENNAS;* all filed together herewith on Nov. 10, 1976, by Cyril M. Kaloi, and commonly assigned.

The present invention is related to antennas and more particularly to microstrip type antennas, especially to microstrip antennas that can be excited to radiate from both sides of the antenna.

SUMMARY OF THE INVENTION

The twin electric microstrip dipole antennas are a family of new microstrip antennas. The twin electric microstrip dipole antennas consist of thin, electrically-conducting rectangular shaped elements formed on both sides of a dielectric substrate. The element on one side of the substrate is the mirror image of the element on the other side of the substrate and each of the elements act, in effect, as a ground plane for the other. The elements can be photo-etched simultaneously on the substrate by techniques used in making printed circuits. The thickness of the substrate to a large extent determines the bandwidth of the antenna. The length of the conducting elements on both sides of the substrate determines the resonant frequency. The twin electric microstrip antennas are very useful in co-linear type arrays, such as stacked or stand-up type antennas and can be used on buoys, towers, boats, aircraft, etc.

This family of microstrip antennas differ from earlier families of microstrip antennas in that both conducting strips are excited to radiate. In the previous microstrip families, the ground plane being larger than the radiating element could not be excited at the same resonant frequency as the radiating element. However, in the case of the twin electric microstrip antenna both elements are efficiently excited. The bandwidth of the twin antennas is dependent upon the thickness of the substrate and width of the elements, i.e., overall width of the antenna. Twin electric microstrip antennas with widths as narrow as the thickness of the substrate have been constructed and operated with satisfactory results.

There are a number of different twin microstrip antennas described herein each having different electrical characteristics and feed systems. These are:

- Notched Fed Electric Twin Microstrip Antennas;
- End Fed Electric Twin Microstrip Antennas;
- Offset Fed Electric Twin Microstrip Antennas;
- Asymmetrically Fed Electric Twin Microstrip Antennas;
- Diagonally Fed Electric Twin Microstrip Antennas;
- Notched/Diagonally Fed Electric Twin Microstrip Antennas; and
- Asymmetrically Fed Magnetic Twin Microstrip Antennas.

In addition to the above twin microstrip antennas various shapes for the twin radiating elements can be used for a variety of different purposes and circumstances. Such shapes include rectangles, squares, triangles, circles, elipses, trapezoids; T, I and L-shapes, cutouts and elements within elements.

BRIEF DESCRIPTION OF THE DRAWINGS

FIG. 2*a* shows an isometric planar view and FIG. 2*b* shows an edge view along the antenna length.

DESCRIPTION AND OPERATION

Figure 1A:
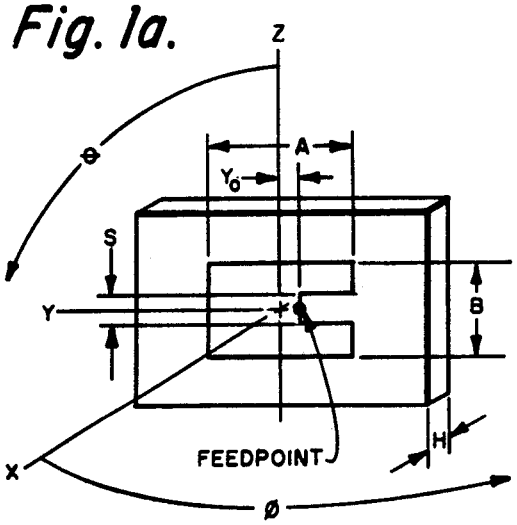
FIGS. 1*a*, 1*b*, 1*c*, 1*d*, 1*e* and 1*f* show the coordinate system used for the: Notched Fed, End Fed, Offset Fed, Asymmetrically Fed, Diagonally Fed, and Notched/-Diagonally Fed Electric Twin Microstrip Antennas, respectively.
Figure 1B:
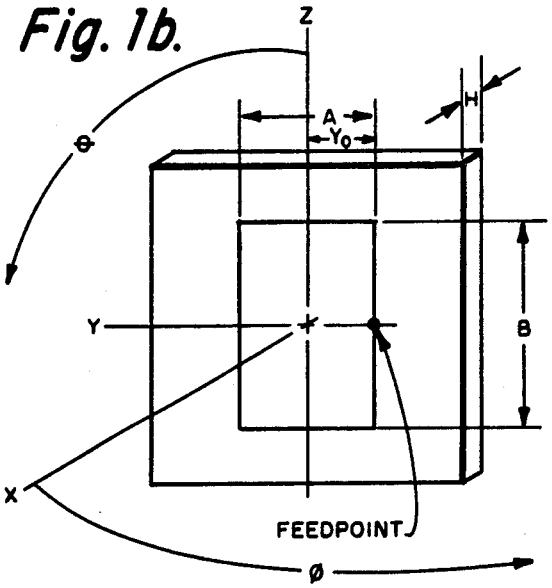
Figure 1C:
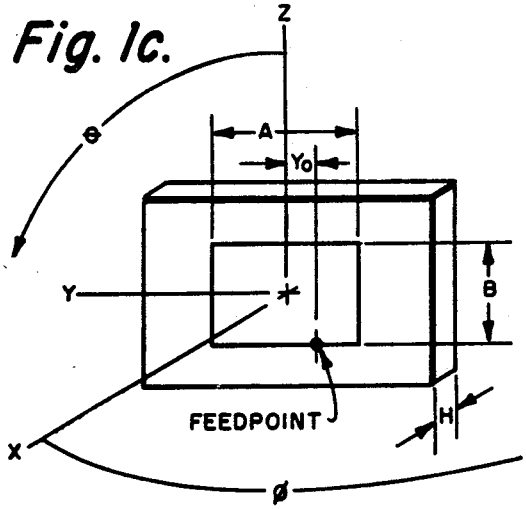
Figure 1D:
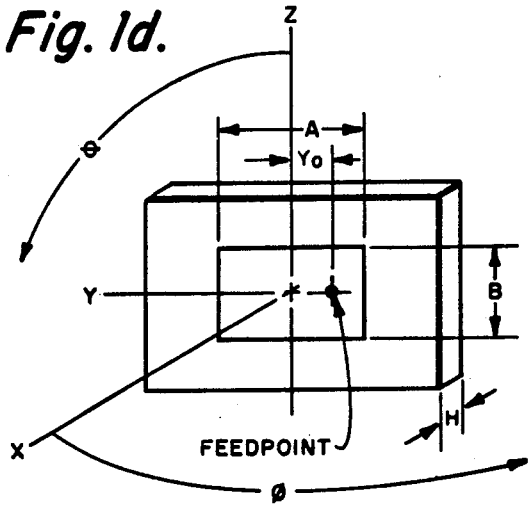
Figure 1E:
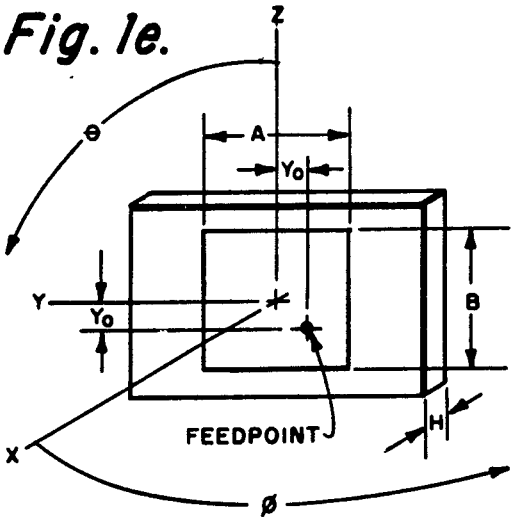
Figure 1F:
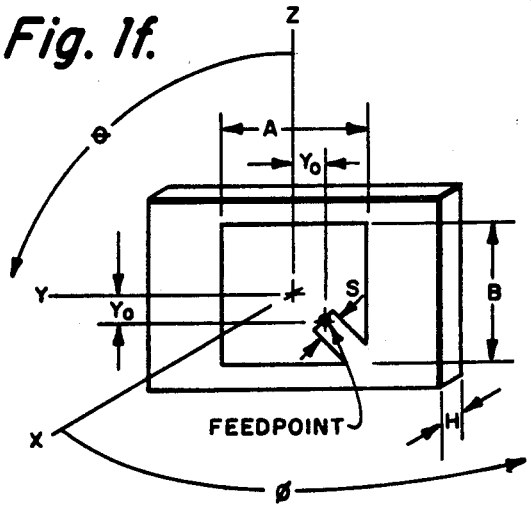

The coordinate system used for various types of the electric twin microstrip antenna family and the alignment of the antenna element within this coordinate system are shown in FIGS. 1a, 1b, 1c, 1d, 1e, 1f. As can be seen, the coordinate system is substantially the same for all the various antennas. The above coordinate systems are in accordance with IRIG (Inter-Range Instrumentation Group) standards and alignment of the antenna elements were made to coincide with the actual antenna radiation patterns that will be shown later. In the case of the electric twin microstrip antenna, the A dimension is the length of each antenna element (i.e., antenna length) the B dimension is the width of each antenna element (i.e., antenna width) and the H dimension is the dielectric substrate thickness. The element length of the twin electric microstrip antennas is approximately one-half wavelength. $Y_o$ is the distance the feed point is located from the center point of the element on the centerline along the element length in FIGS. 1a, 1b and 1d. In FIG. 1c, $Y_o$ is the dimension that the feed point is located along the element edge from the centerline across the width of the element. In FIGS. 1e and 1f, $Y_o$ is the distance the feed point is located from the centerlines of both the length and the width of the element; the resultant of the two $Y_o$ vectors is the distance from the centerpoint along the diagonal of the element. In FIGS. 1a and 1f, the dimension S is the width of the notch and is determined primarily by the width of the microstrip transmission lines used.

The thickness of the dielectric substrate, dimension H, in the electric twin microstrip antennas should be much less than ¼ the wavelength. For thickness approaching ¼ the wavelength, an antenna will radiate in a hybrid mode in addition to radiating in a microstrip mode. Extension of the dielectric substrate beyond the element edges is not required for proper operation of the antenna. However, for practical purposes such an extension is useful for mounting purposes and/or for etching microstrip transmission lines.

In addition, the twin microstrip antenna can be designed for any desired frequency within a limited bandwidth, preferably below 25 GHz, since the antenna will tend to operate in a hybrid mode (e.g., a microstrip/monopole/waveguide mode) above 25 GHz for most commonly used stripline materials. However, for clad materials thinner than 0.031 inch, higher frequencies can be used. The design technique used for these antennas provides antennas with ruggedness, simplicity and low cost. The thickness of the present antennas can be held to an extreme minimum depending upon the bandwidth requirement; antennas as thin as 0.005 inch for frequencies above 1,000 MHz have been successfully produced. In most instances, the antenna is easily matched to most practical impedances by varying the location of the feed point along the element.

Another advantage of the twin microstrip antenna over most other types of microstrip antennas is that the present antenna can be fed very easily from either side.

Figure 2A:
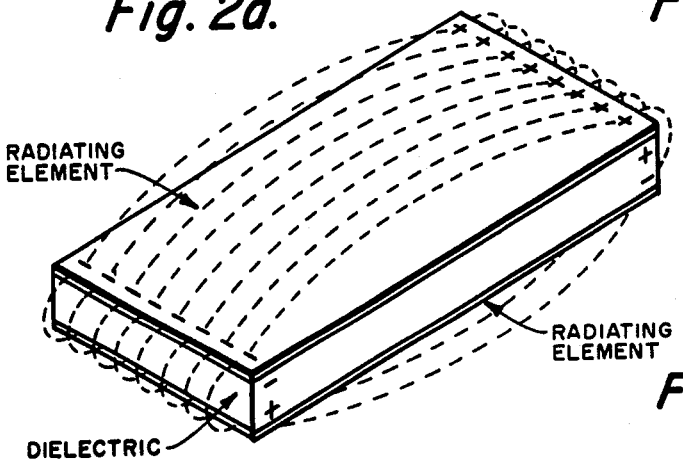
FIGS. 2*a* and 2*b* show the near field configuration for a typical twin microstrip antenna, particularly for the notched fed, end fed and asymmetrically fed antennas, and to some extent for the offset fed twin antenna.
Figure 2B:
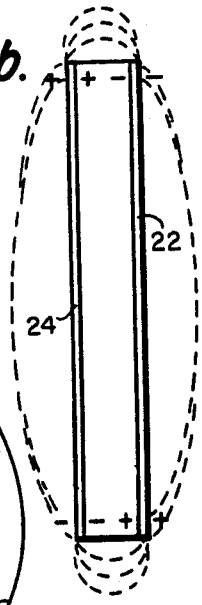

FIGS. 2a and 2b show the near field configuration for a typical electric twin microstrip antenna. This configuration applies primarily to the notched fed, end fed, and asymmetrically fed antennas, and to some extent to the offset fed electric twin microstrip antenna depending on the element width. As to the offset fed twin antenna, for widths approaching ¼ wavelength or less, for example, the cross fields are very minimal. Usually the above antennas are rectangular with the A dimension being greater than the B dimension. As can be seen from FIG. 2 there are fields on each of the broadsides of the twin microstrip antenna assembly. The broadside fields of each of the elements are excited independently of one another. Therefore, the field of the element on one side is 180° out of phase with the field of the element on the opposite side. A reflector can be used to reflect radiation from one of the twin radiating elements in the same direction as the other radiating element, as will be discussed later. There are also fields on the edges along the shorter sides of the antenna, as shown. The results of the above near fields give an omnidirectional far field pattern in the XY plane around the length of the twin elements, as will be shown below in the radiation patterns. The radiation patterns in the XZ plane is essentially a figure eight pattern. A true figure eight pattern can be achieved if both elements are excited with the same amount of energy. The near field configuration of FIGS. 2a and 2b also indicates that the polarization is linear along the length of the twin antennas.

Figure 3A:
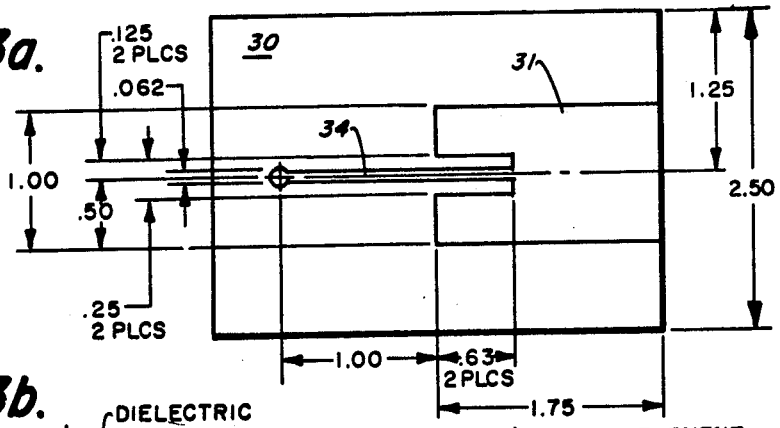
FIGS. 3*a*, 3*b* and 3*c* show a planar view of one side, an edge view, and a planar view of the opposite side, respectively, of a typical notch fed electric twin microstrip antenna.
Figure 3G:
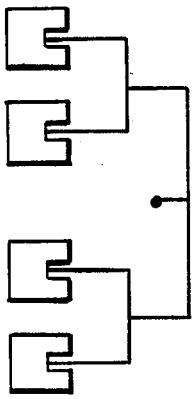
FIG. 3*g* shows a planar view of a typical array of twin microstrip antennas.

The elements of the electric twin microstrip dipole antennas can be arrayed in the same manner as disclosed in the aforementioned U.S. patents to provide higher gain, and with the exception of the Asymmetrically Fed Twin and Diagonally Fed Twin antennas can be arrayed with interconnecting twin microstrip transmission lines, such as typically shown in FIG. 3g. In most instances these microstrip transmission lines can be simultaneously etched along with the elements on the substrate. A coaxial-to-microstrip adapter can be used for directly feeding the twin antenna elements or feeding the twin microstrip transmission lines etched with the elements. The adapter is mounted and electrically connected to the element or transmission line on one side of the antenna with the center pin of the adapter extending through the substrate and electrically connected to the second (i.e., twin) element or transmission line on the directly opposite side of the substrate.

Figure 3B:
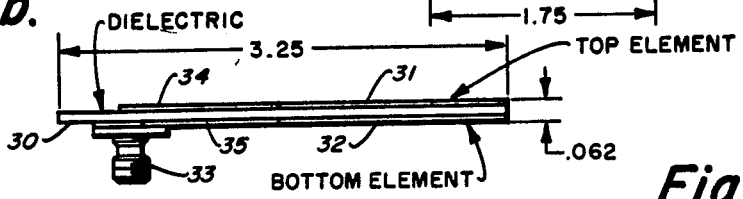
Figure 3C:
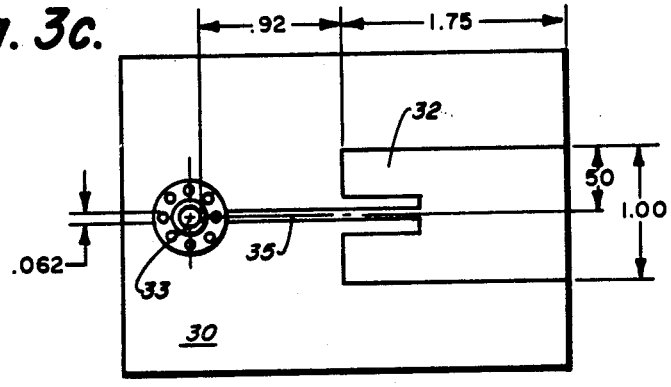
Figure 3F:
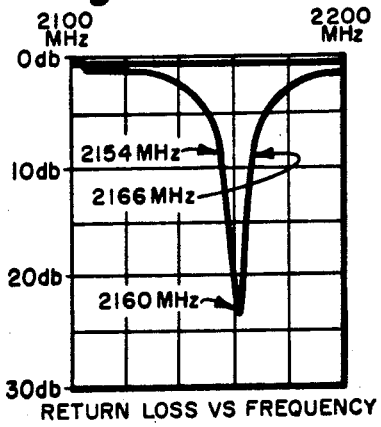
FIG. 3*f* is a plot showing the return loss versus frequency for the notch fed electric twin microstrip antenna shown in FIGS. 3*a*, 3*b* and 3*c*.
Figure 3D:
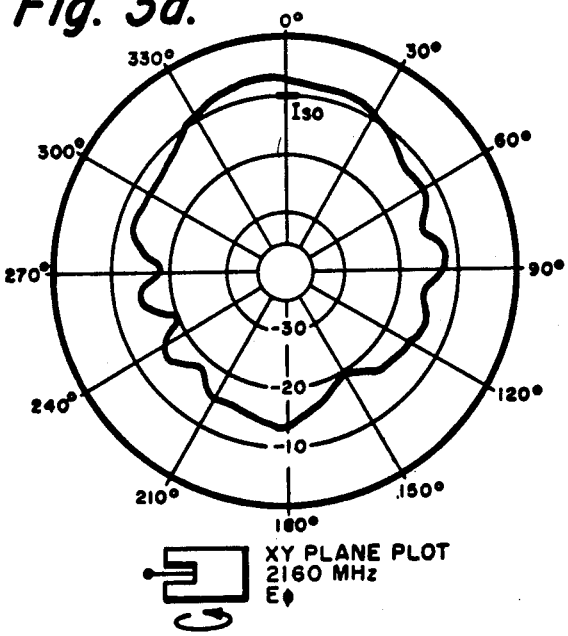
FIGS. 3*d* and 3*e*, show antenna radiation patterns for the XY plane and XZ plane, respectively, for a typical notch fed electric twin microstrip antenna having the dimensions given in FIGS. 3*a*, 3*b* and 3*c*.
Figure 3E:
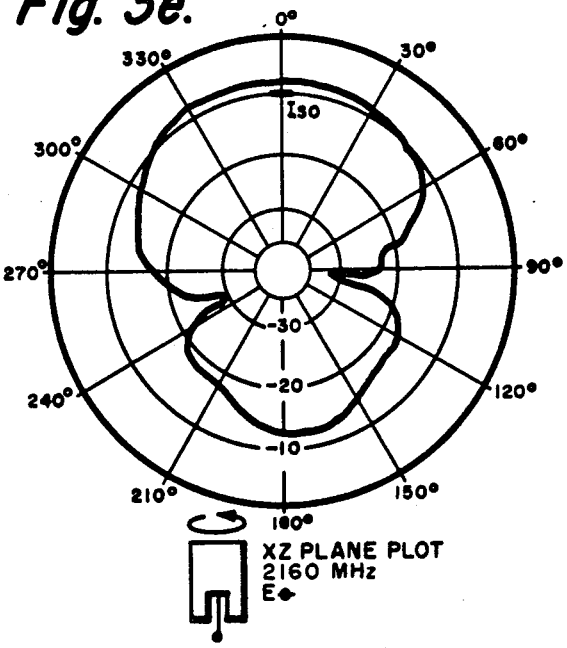

FIGS. 3a, 3b and 3c show a typical notch fed electric twin microstrip antenna. Dielectric substrate 30 separates the twin elements 31 and 32. Element 31 on one side of dielectric substrate 30 is a duplicate or mirror image of element 32 on the opposite side of the substrate. The elements as shown in FIGS. 3a, 3b and 3c are fed with a coaxial-to-microstrip adapter 33 connected via twin microstrip transmission lines 34 and 35. An advantage of the twin notched fed twin antenna is that it is possible to locate the feed point for optimum match or input impedance. However, an added advantage is that the notched fed twin antenna can be fed with etched twin microstrip transmission lines also at the optimum match location as shown in FIGS. 3a and 3c. This is a more desirable method of feed especially in arraying several antennas, as shown in FIG. 3g. Radiation patterns for the XY and XZ planes are shown in FIGS. 3d and 3e, respectively, for this antenna with the dimensions as given in FIGS. 3a, 3b and 3c. Return loss versus frequency is shown in FIG. 3f for this antenna.

A variance of the notch fed electric twin microstrip antenna is to notch only one of the elements and feed both elements from a coaxial-to-microstrip adapter from the unnotched element side. When feeding from a coaxial-to-microstrip adapter the adapter flange would in effect short out the notch due to the small size of the element and notch. When using twin microstrip transmission lines, the type feed used is optional.

Figure 4A:
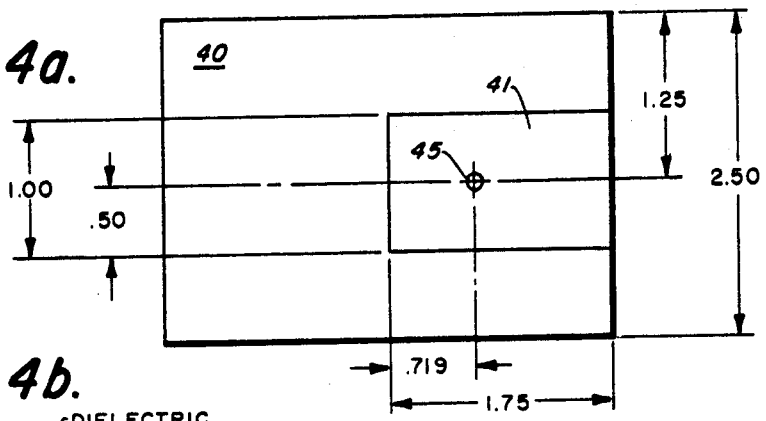
FIGS. 4*a*, 4*b* and 4*c* show a planar view of one side, an edge view, and a planar view of the opposite side, respectively, of a typical asymmetrical fed electric twin microstrip antenna.
Figure 4B:
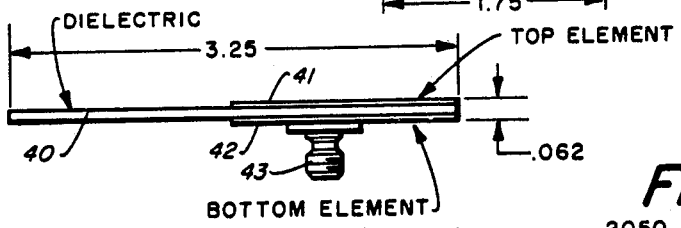
Figure 4C:
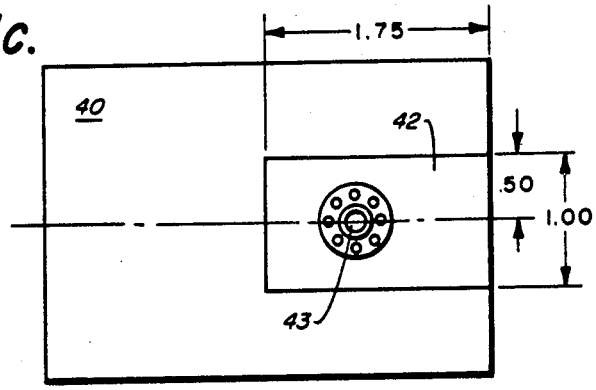
Figure 4F:
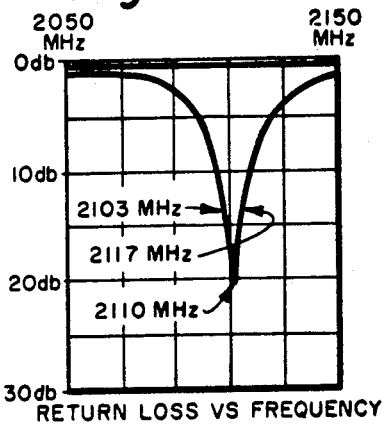
FIG. 4*f* is a plot showing the return loss versus frequency for the asymmetrical fed electric twin microstrip antenna shown in FIGS. 4*a*, 4*b* and 4*c*.
Figure 4D:
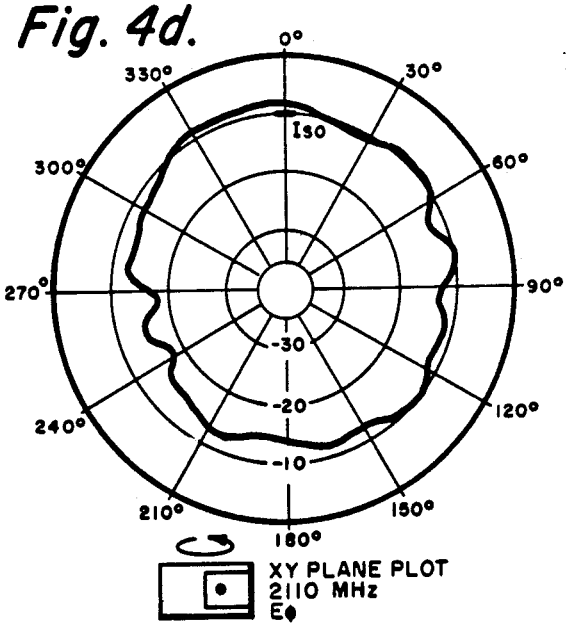
FIGS. 4*d* and 4*e*, show antenna radiation patterns for the XY plane and XZ plane, respectively, for a typical asymmetrical fed electric twin microstrip antenna having the dimensions given in FIGS. 4*a*, 4*b* and 4*c*.
Figure 4E:
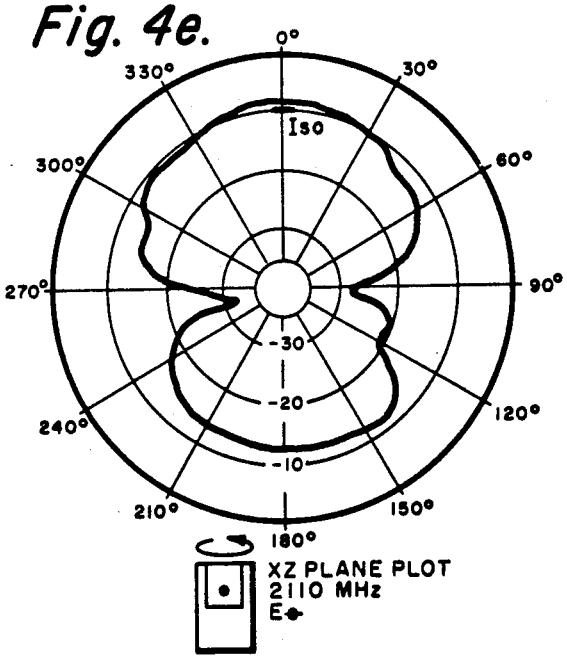
Figure 5A:
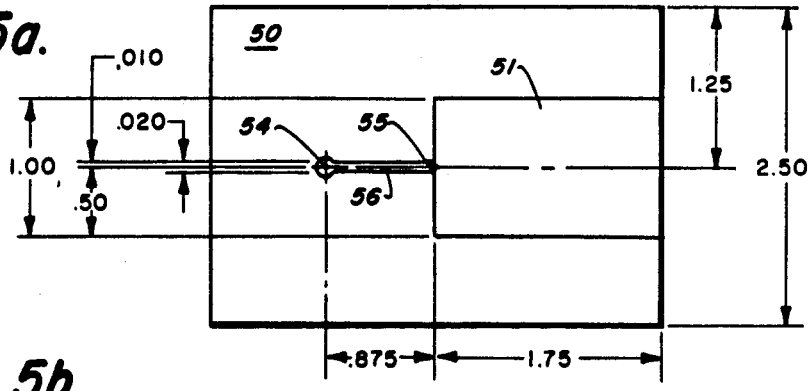
FIGS. 5*a*, 5*b* and 5*c* show a planar view of one side, an edge view, and a planar view of the opposite side, respectively, of a typical end fed electric twin microstrip antenna.
Figure 5B:
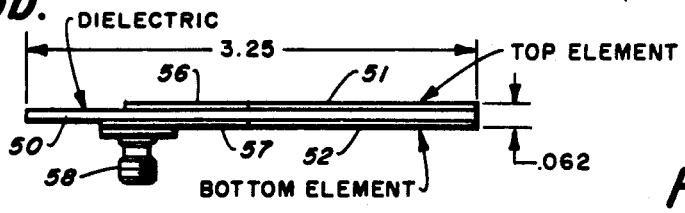
Figure 5C:
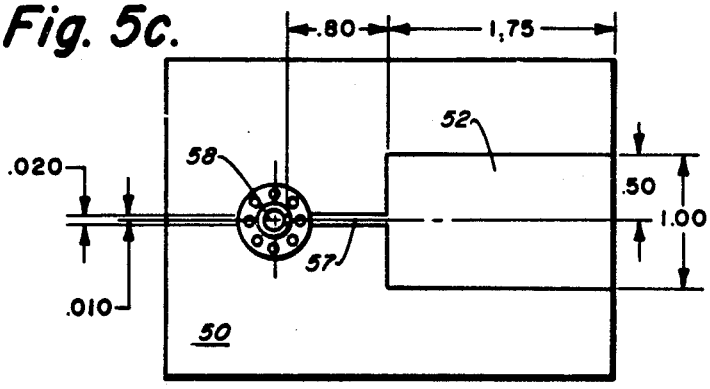
Figure 5F:
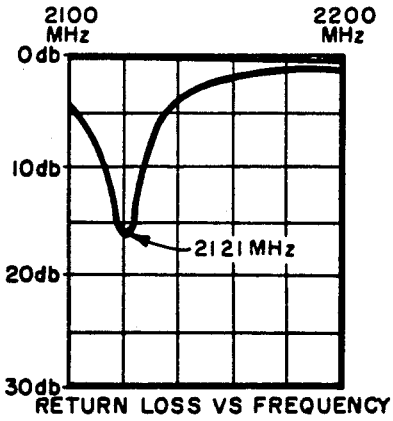
FIG. 5f is a plot showing the return loss versus frequency for the end fed electric twin microstrip antenna shown in FIGS. 5a, 5b and 5c.
Figure 5D:
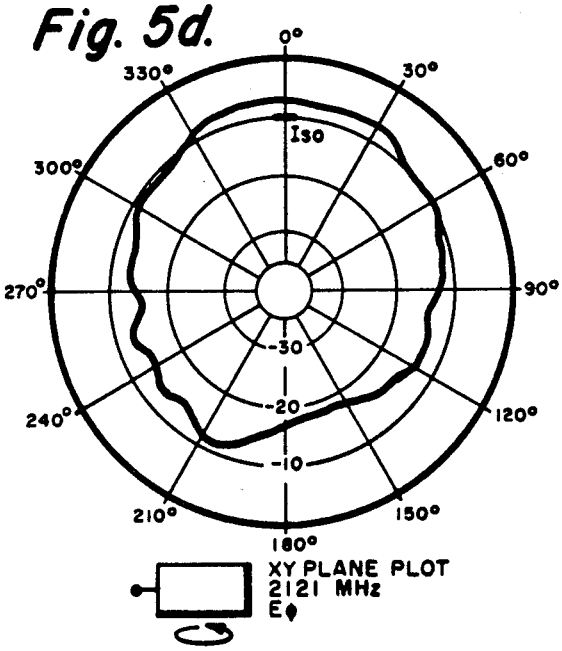
FIGS. 5*d* and 5*e*, show antenna radiation patterns for the XY plane and XZ plane, respectively, for a typical end fed electric twin microstrip antenna having the dimensions given in FIGS. 5a, 5b and 5c.
Figure 5E:
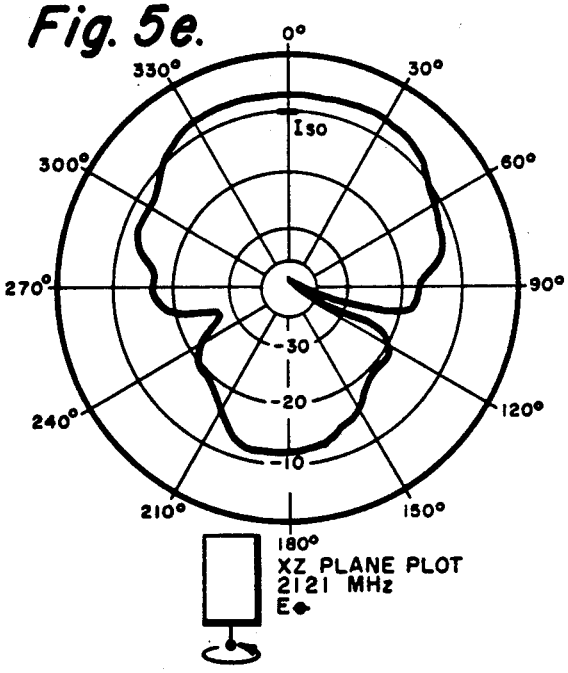
Figure 6A:
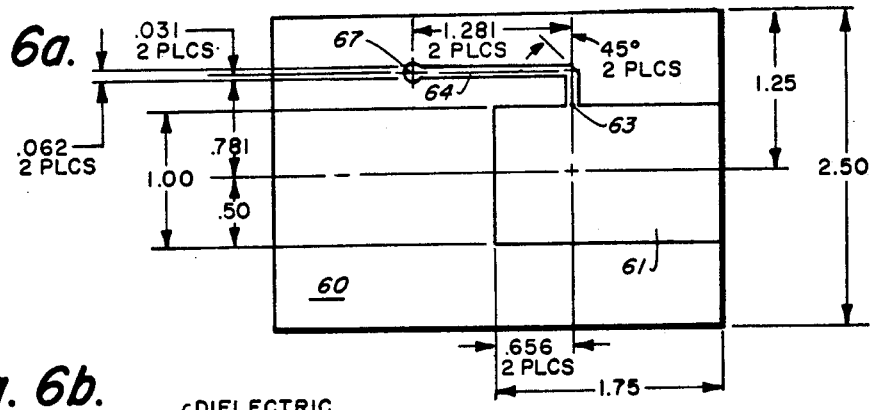
FIGS. 6a, 6b and 6c show a planar view of one side, an edge view, and a planar view of the opposite side, respectively, of a typical offset fed electric twin microstrip antenna.
Figure 6B:
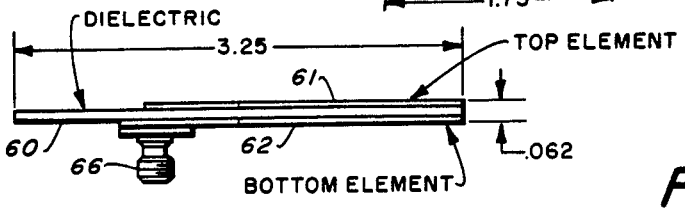
Figure 6C:
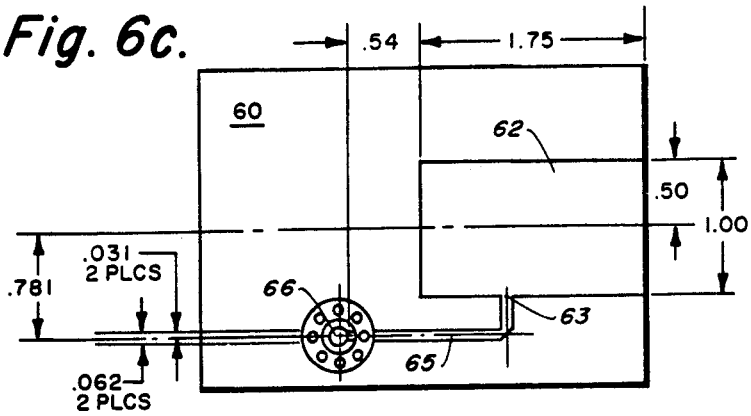
Figure 6F:
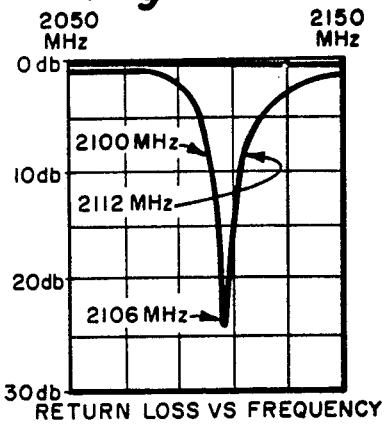
FIG. 6f is a plot showing the return loss versus frequency for the offset fed electric twin microstrip antenna shown in FIGS. 6a, 6b and 6c.
Figure 6D:
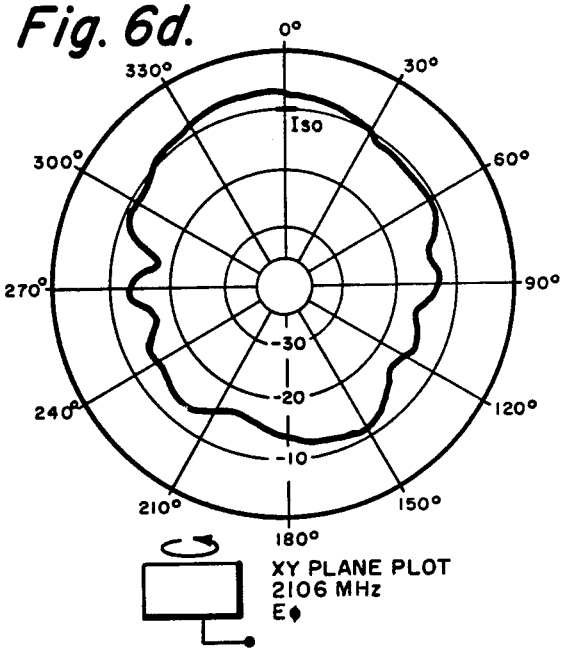
FIGS. 6d and 6e, show antenna radiation patterns for the XY plane and XZ plane respectively, for a typical offset fed electric twin microstrip antenna having the dimensions given in FIGS. 6a, 6b and 6c.
Figure 6E:
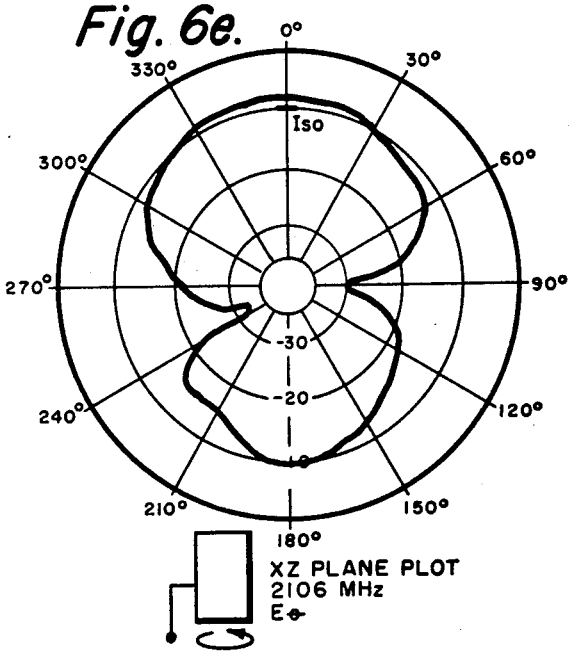
Figure 7A:
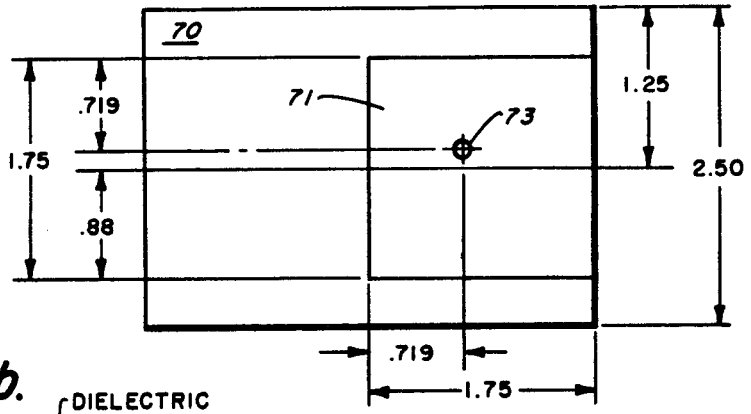
FIGS. 7a, 7b and 7c show a planar view of one side, an edge view, and a planar view of the opposite side, respectively, of a typical diagonally fed electric twin microstrip antenna.
Figure 7B:
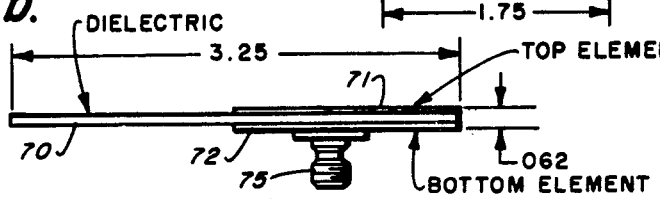
Figure 7C:
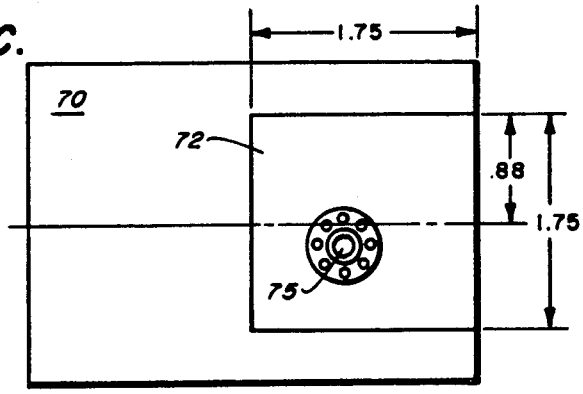
Figure 7F:
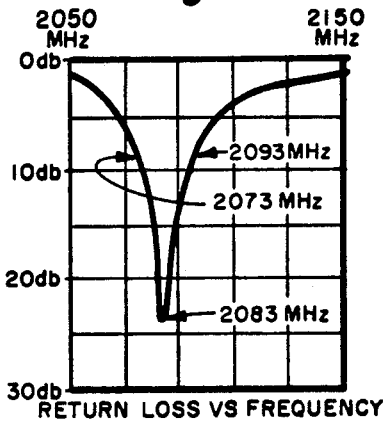
FIG. 7f is a plot showing the return loss versus frequency for the diagonally fed electric twin microstrip antenna shown in FIGS. 7a, 7b and 7c.
Figure 7D:
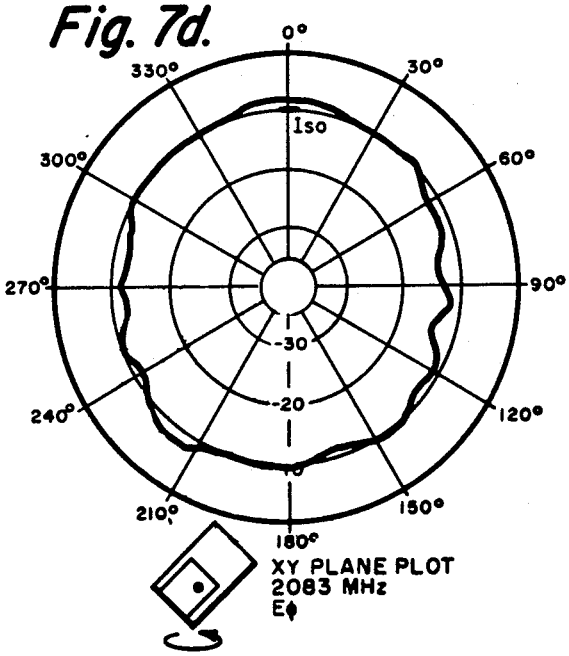
FIGS. 7d and 7e, show antenna radiation patterns for the XY plane and XZ plane, respectively, for a typical diagonally fed electric twin microstrip antenna having the dimensions given in FIGS. 7a, 7b and 7c.
Figure 7E:
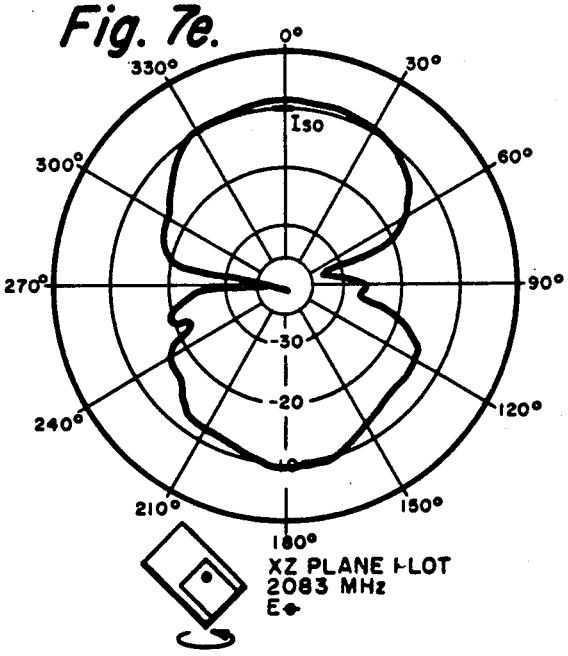
Figure 8A:
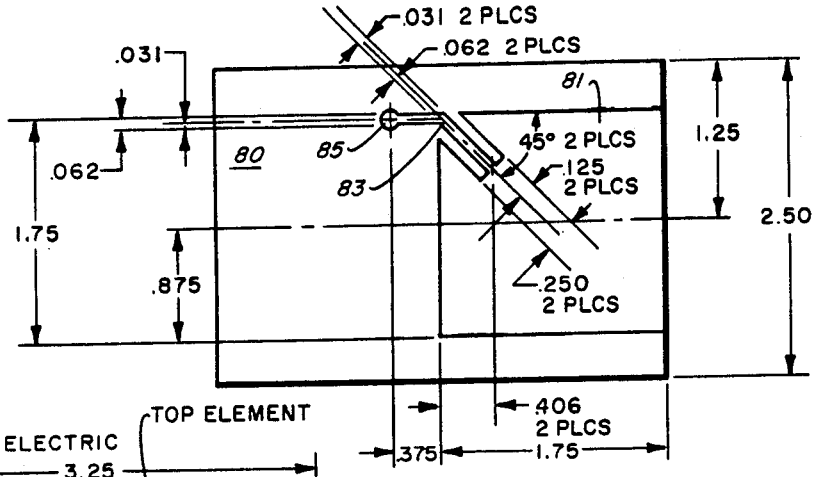
FIGS. 8a, 8b and 8c show a planar view of one side, an edge view, and a planar view of the opposite side, respectively, of a typical notched/diagonally fed electric twin microstrip antenna.
Figure 8B:
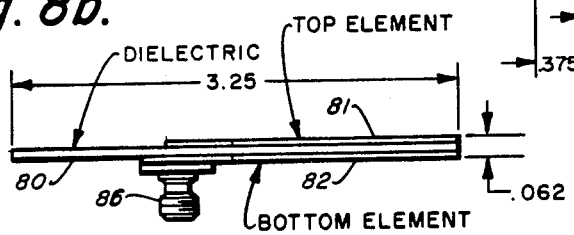
Figure 8C:
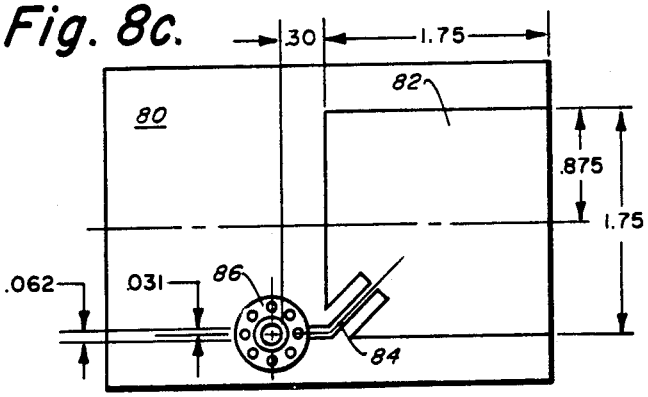
Figure 8F:
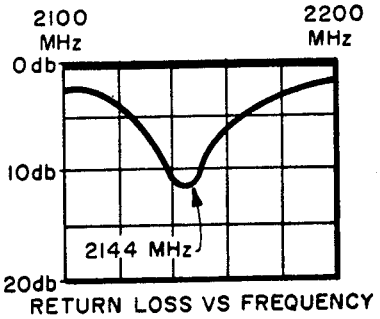
FIG. 8f is a plot showing the return loss versus frequency for the notched/diagonally fed electric twin microstrip antenna shown in FIGS. 8a, 8b and 8c.
Figure 8D:
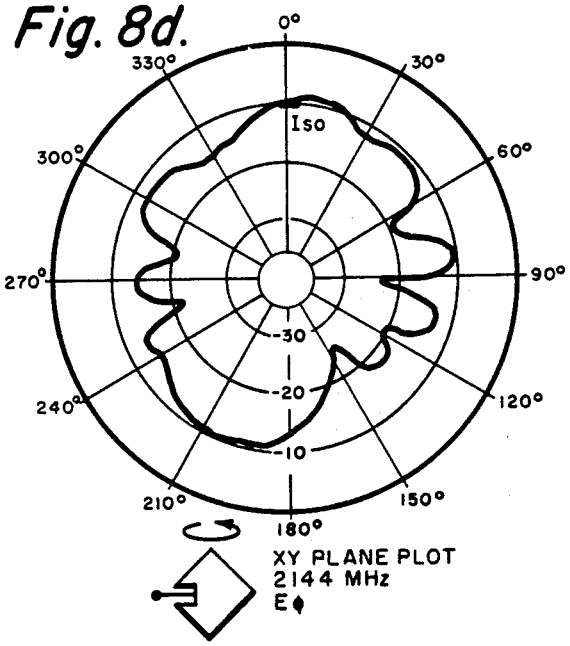
FIGS. 8d and 8e, show antenna radiation patterns for the XY plane and XZ plane, respectively, for a typical notched/diagonally fed electric twin microstrip antenna having the dimensions given in FIGS. 8a, 8b and 8c.
Figure 8E:
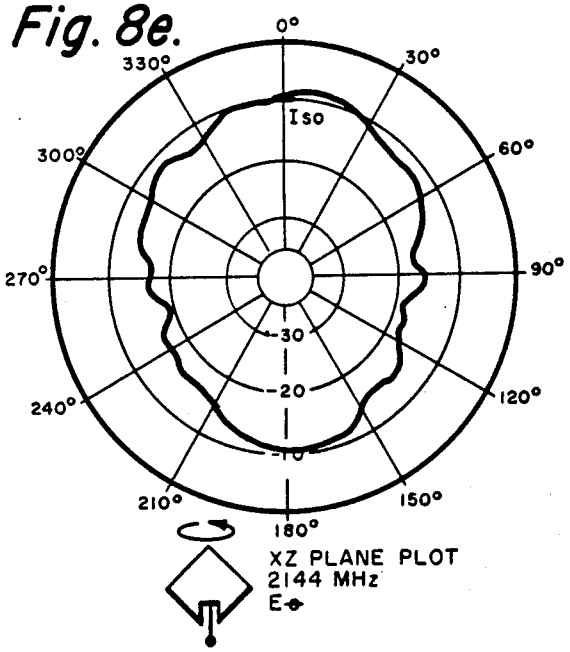

FIGS. 4a, 4b and 4c show a typical asymmetrical fed twin electric microstrip antenna. Dielectric substrate 40 separates the elements 41 and 42 which are duplicates of one another directly opposite each other on opposite sides of the substrate. This antenna is fed by means of coaxial-to-microstrip adapter 43 and can be fed from either side. The feed point 45 is located along the centerline of the antenna length and the input impedance can be varied by moving the feed point along the centerline from the center point to an end of the antenna without affecting the radiation pattern. The antenna bandwidth increases with the width B of the element and the spacing between the two elements (i.e., dielectric thickness) with the spacing between the elements having the most effect. Arraying is usually done with external coaxial feed lines. In this antenna the width B can be made as narrow as the substrate thickness, for example 0.093 inch. For the twin asymmetrically fed antenna having the dimensions given in FIGS. 4a, 4b and 4c, radiation patterns are shown in FIGS. 4d and 4e for the XY and XZ planes, respectively. FIG. 4f shows the return loss versus frequency plot for this antenna.

FIG. 5 shows a typical twin end fed antenna. Dielectric 50 separates one element 51 from twin element 52 directly opposite thereto on opposite sides of the substrate. Because of the very high impedance at the end of the antenna elements a matching network is usually necessary between the connecting point 54 and the actual feed point 55. A matching network of twin microstrip transmission lines 56 and 57 can be etched along with the elements as shown in the drawing. A plurality of twin end fed antennas can be arrayed using microstrip interconnecting twin transmission lines etched along with the elements. The twin matching network and/or twin microstrip transmission lines 56 and 57 are fed from a coaxial-to-microstrip adapter 58, as shown. The radiation patterns for the XY and XZ planes respectively, for a twin end fed microstrip antenna having the given dimensions as in FIGS. 5a, 5b and 5c are shown in FIGS. 5d and 5e. Also, the return loss versus frequency plots are shown in FIG. 5f.

For purely dipole mode action square elements are the limit as to how wide the elements can be without exciting other higher modes of radiation. However, by making the length of the antenna approximately one-half wavelength and the width approximately one wavelength quadrupole action can be provided. The elements when excited will then operate in a degenerate mode with two oscillation modes occurring at the same frequency. Oscillation in a dipole mode will occur along the length of the twin radiating elements while oscillation in a quadrupole mode will occur along the width of the twin elements.

FIG. 6 shows a typical twin offset fed antenna. Dielectric 60 separates the twin elements 61 and 62. Element 61 on one side of dielectric 60 is a mirror image of element 62 on the opposite side of the substrate. An advantage of the twin offset fed antenna is that it can be fed at the optimum feed point 63 with etched twin microstrip lines 64 and 65 or directly at the feed point with a coaxial-to-microstrip adapter in the same manner as the ends of the twin microstrip lines 64 and 65 are fed with coaxial-to-microstrip adapter 66 at connection point 67. The width of this antenna can also be made as narrow as the substrate thickness, for example 0.093 inch. Antenna radiation pattern for the XY and XZ planes, respectively, are shown in FIGS. 6d and 6e for the twin offset antenna having the dimensions given in FIGS. 6a, 6b and 6c. The return loss versus frequency for this antenna is shown in FIG. 6f.

FIG. 7 shows a typical twin diagonally fed electric microstrip antenna. As in the other twin antennas the dielectric substrate 70 separates the twin elements 71 and 72 directly opposite to each other on opposite sides of the substrate. The feed point 73 is located along a diagonal of the antenna elements and the input impedance can be varied to match any source impedance by simultaneously moving the feed points (directly opposite to each other) along the diagonal line of the twin antenna elements without affecting the radiation pattern. A coaxial-to-microstrip adapter 75 is used to feed the twin antennas, in the same manner as for the asymmetrically fed twin antenna aforementioned. The elements should be square for linear polarization and for circular polarization the B dimension should be slightly shorter than the A dimension, or vise versa, depending on whether right hand or left hand circular polarization is desired. Only one feed point 73 (on each element) is required to obtain circular polarization with this antenna, and the antenna can be fed from either side. This antenna is arrayed with external coaxial cables. For linear polarization in the case of a square, the polarization is in a direction along the diagonal on which the feed point lies on both sides of the antenna. Typical antenna radiation patterns are shown in FIGS. 7d and 7e for the XY and XZ planes, respectively, for an antenna having the dimensions shown in FIGS. 7a, 7b and 7c. Circular polarization patterns can be obtained for both the twin diagonal antenna and twin notch/diagonal antenna described below in substantially the same manner as disclosed in aforementioned U.S. Pat. No. 3,984,834; and, in aforementioned copending Patent Applications, Ser. No. 740,696 now U.S. Pat. No. 4,051,478 for Notched/Diagonally Fed Electric Microstrip Dipole Antenna; and Ser. No. 740,692 now U.S. Pat. No. 4,067,016 for Circularly Polarized Electric Microstrip Antennas. For the square element (linear polarization) the cross polarization components are minimal and therefore not shown. The return loss versus frequency plot is shown in FIG. 7f for the antenna shown in FIGS. 7a, 7b and 7c.

FIG. 8 shows a twin notched/diagonally fed electric microstrip antenna. Substrate 80 separates the twin elements 81 and 82 as in the above antennas. The dimension features of the diagonally fed antenna above are also applicable here. In this antenna, a notch is cut out from the corner of each element to the desired feed point such the element 81 is a mirror image of element 82 on the opposite side of substrate 80. This antenna can be fed and arrayed with either type transmission line and also with only one element notched as in the notch fed twin antenna described above. Twin microstrip transmission lines 83 and 84 can be etched along with the elements 81 and 82 and fed at the connection points 85 with a coaxial-to-microstrip adapter 86, as shown in the drawings. Linear or circular polarization is possible with this type twin antenna as in the twin diagonally fed antenna. Antenna radiation patterns are shown in FIGS. 8d and 8e for the notch/diagonal twin electric microstrip antennas for the XY plane and XZ plane, respectively. Fig. 8f shows the return loss versus frequency plot for this antenna. The cross polarization components are minimal and therefore not shown for any of the antennas described above.

The various electric twin microstrip antennas differ from one another both physically and in their electrical characteristics. The offset fed antenna can be connected directly to whatever input impedance match feed point is desired on the antenna by using twin microstrip transmission lines. In addition, the offset element can be made as narrow as the losses (i.e., copper and dielectric losses) allow (this is not true for the notch fed antenna, however). The asymmetrically fed antenna can be fed from one side or the other and made as narrow as the losses or the connector flange permits. The notch fed antenna can be fed at the optimum feed point along the centerline, but can not be made as narrow as some of the other antennas. The polarization linearity of the notch fed, end fed and asymmetric fed antennas are much purer than the offset fed antennas due to excitation of cross-feed components by virtue of the offset antenna being fed on the edge of the elements. Each of the various antenna types has a distinct advantage over the others.

Figure 2C:
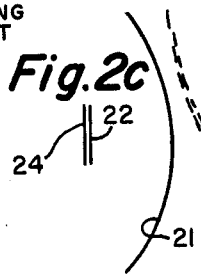
FIG. 2*c* shows a side view of an antenna as in FIG. 2*b* used with a reflector.

As previously mentioned, the various twin electric microstrip antennas each have the capability of being used with a reflector, such as 21 shown in FIG. 2c, for reflecting the radiation from one radiating element 22 in the same direction as the radiation from the other radiating element 24, since one element is a mirror image of the other and thus 180° out of phase with each other, thereby increasing the radiation signal from the antenna in one direction. However, the radiation from the elements must be exactly 180° out of phase in order that the reflected radiation from the one radiating element 22 will be in phase with the direct radiation from the other radiating element 24. If the 180° phasing is not accurate some cancellation of signal can occur.

Figure 9:
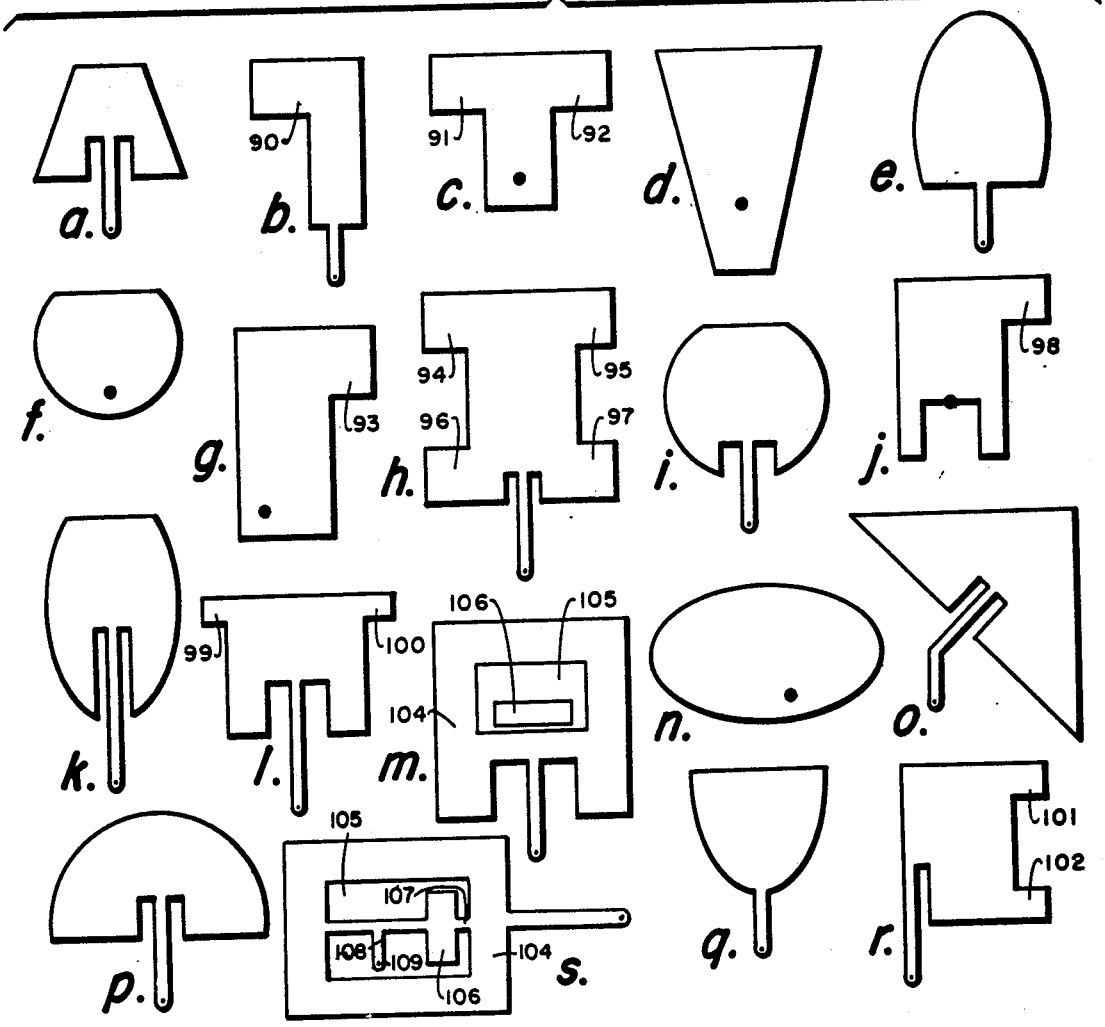
FIGS. 9a through 9s show a variety of shapes for twin electric microstrip antenna radiating elements using various feed systems.

As was mentioned earlier, a variety of radiator shapes can be used for the twin microstrip antenna elements for different purposes and under a variety of circumstances. FIGS. 9a thru 9s show a variety of element shapes using various feed systems, by way of example.

In the L, I and T-shaped elements, shown in FIGS. 9b, c, g, h, j, l, as well as FIG. 9r, the side or wing extensions 90, 91, 92, 93, 94, 95, 96, 97, 98, 99, 100, 101 and 102 on the elements act as reactive loads for each antenna. The effect of the loads is to obtain a lower frequency and yet not extend beyond the desired length of the antenna element, but merely extend a portion of the element width. This type loading in the width provides a much more reactive load and reduces the center frequency of the antenna more than can be attained by increasing the width of the antenna the same amount along the entire length thereof. The T-shaped elements such as in FIGS. 9c and 9l can be used to double the reactive loading and the loads of the I-shaped element such as in FIG. 9h will approximately quadruple the reactive loading for that element. In the I-shaped elements, such as in FIG. 9h, or in the element of FIG. 9r the loads along the length should not approach each other too closely since the reactive effect can be lost and the load portion become a part of the radiating element. In other words, load 94 should not be too close to load 96, 95 should not be close to 97, and 101 should not be close to 102.

Various other configurations as shown in FIGS. 9a thru 9s can be used to fit areas that require special space saving techniques, etc. and can be fed with a variety of feed systems as shown and previously described.

In the element 104 shown in FIG. 9m, a center portion 105 can be cut out (i.e., removed), and this antenna can be notch fed as shown or fed by a variety of feed systems as discussed. If desired, a second and smaller antenna element 106 can be formed within the cut out area 105 and coupled fed from the larger element 104. Each of the elements can be fed with separate feedlines, if desired. However, by proper arrangement the smaller element 106 can be secondarily fed from the larger element 104, if desired, with a small transmission line 107 from the larger element 104 to the smaller element 106, as shown in FIG. 9s for example. A further means for feeding elements 104 and 106 would be to provide a microstrip T-feed line 108 within space 105 between the two elements as also shown in FIG. 9s and feed both the larger and smaller elements from a common connection at 109 to a coaxial-to-microstrip adapter without a line 107. FIG. 9r shows a loaded offset/notched microstrip antenna element. This is merely an example of how various feed systems and factors can be combined to meet special or complex physical constraints on electrical requirements in twin electric microstrip antenna design.

Obviously many modifications and variations of the present invention are possible in the light of the above teachings. It is therefore to be understood that within the scope of the appended claims the invention may be practiced otherwise than as specifically described.

What is claimed is:

1. An asymmetrically fed twin electric microstrip dipole antenna structure, comprising:

a. a dielectric substrate;
b. a twin pair of thin rectangular radiating elements disposed one each on opposite sides of said dielectric substrate which electrically separates the twin radiating elements;
c. the radiating element on one side of said dielectric substrate being directly opposite to and the mirror image of the radiating element on the other side of said dielectric substrate;
d. each of said twin radiating elements being operable to be excited to radiate in a microstrip mode, and each of said twin radiating elements acting as a ground plane for the other;
e. the broadside fields of each of the twin radiating elements being excited in identical modes of oscillation, radiating independently of each other with respective fields on opposite sides of the dielectric substrate being 180 degrees out of phase with one another;
f. said twin radiating elements each having a feed point located along the centerline of the length thereof; said feed points being directly opposite to one another;
g. the length of the radiating elements determining the resonant frequency of said antenna;
h. the antenna input impedance being variable to match most practical impedances as said feed point is moved along said centerline between the radiating element center point and the end of the radiating element in either direction without affecting the antenna radiation pattern;
i. the antenna bandwidth being variable with the width of the radiating elements and the spacing between said twin radiating elements, the spacing between the twin radiating elements having somewhat greater effect on the bandwidth than the radiating element width.

2. An antenna as in claim 1 wherein said twin antenna is operable to be fed at said feed points from either radiating element broadside thereof.

3. An antenna as in claim 1 wherein said radiating element is in the form of a square, said square radiating element being the limit as to how wide the radiating element can be without exciting higher order modes of radiation.

4. An antenna as in claim 1 wherein a plurality of said twin antennas are co-linear arrayed to provide a higher gain.

5. An antenna as in claim 1 wherein the length of said radiating elements are equal and approximately ½ wavelength.

6. An antenna as in claim 1 wherein said antenna operates to provide an omnidirectional far field pattern in the XY plane around the length of the twin radiating elements.

7. An antenna as in claim 1 wherein the efficiency of the twin antenna is dependent upon the thickness of said dielectric substrate and the width of the twin radiating elements.

8. An antenna as in claim 1 wherein said twin radiating elements are fed from a coaxial-to-microstrip adapter, said adapter being attached to one radiating element on one side of the dielectric substrate with the center pin of the adapter extending through said one radiating element and the dielectric substrate to the other radiating element on the opposite side of said dielectric substrate.

9. An antenna as in claim 1 wherein said twin radiating elements are fed with twin microstrip transmission lines disposed on opposite sides of said dielectric substrate along with said radiating elements.

10. An antenna as in claim 1 wherein the minimum width of said radiating element is determined by the thickness of the dielectric substrate.

11. An antenna as in claim 1 wherein at least one extension of a portion of the width of each of said radiating elements is provided at any of the ends thereof; said at least one extension on each of the twin radiating elements being the mirror image of the other; said at least one width extensions acting as a reactive load for the twin antenna for obtaining lower frequency operation without increasing the length of said radiating elements.

12. A twin electric microstrip dipole antenna structure, comprising:
a. a dielectric substrate;
b. a twin pair of thin radiating elements disposed one each on opposite sides of said dielectric substrate which operates to electrically separate the two radiating elements;
c. the radiating element on one side of said dielectric substrate being directly opposite to and the mirror image of the radiating element on the other side of said dielectric substrate;
d. each of said twin radiating elements being operable to be excited to radiate in a microstrip mode, and each of said twin radiating elements acting as a ground plane for the other;
e. the broadside fields of each of the antenna radiating elements being excited in identical modes of oscillation, radiating independently of each other with respective fields on opposite sides of the dielectric substrate being 180 degrees out of phase with one another;
f. each of said twin radiating elements being asymmetrically fed, at a feed point located on the radiating elements; said feed points being directly opposite to each other;
g. the length of said twin radiating elements determining the resonant frequency of the antenna;
h. the input impedance of said antenna being variable to match most practical impedances as said feed points are moved on the radiating elements;
i. the antenna bandwidth being variable with the width of the radiating elements and the spacing between said twin radiating elements, the spacing between the twin radiating elements having somewhat greater effect on the bandwidth than the radiating element width.

13. An antenna as in claim 12 wherein a plurality of said twin antennas are co-linear arrayed to provide a higher gain.

14. An antenna as in claim 12 wherein the length of said radiating elements are equal and approximately ½ wavelength.

15. An antenna as in claim 12 wherein said twin radiating elements are fed from a coaxial-to-microstrip adapter, said adapter being attached to one radiating element on one side of the dielectric substrate with the center pin of the adapter extending through said one radiating element and the dielectric substrate to the other radiating element on the opposite side of said dielectric substrate.

16. An antenna as in claim 12 wherein said twin radiating elements are fed with twin microstrip transmission lines disposed on opposite sides of said dielectric substrate along with said radiating elements.

17. An antenna as in claim 12 wherein at least one extension of a portion of the width of each of said radiating elements is provided at any of the ends thereof; said at least one extension on each of the twin radiating elements being the mirror image of the other; said at least one width extensions acting as a reactive load for the twin antenna for obtaining lower frequency operation without increasing the length of said radiating elements.

18. An antenna as in claim 12 wherein each of said radiating elements have a center conducting portion thereof removed and respective secondary radiating elements, smaller than the removed portions are disposed on each side of said dielectric substrate within the area of said removed portions and spaced from said radiating elements; said radiating elements and secondary radiating elements being disposed directly opposite to each other on opposite sides of said dielectric substrate; said smaller secondary radiating elements being operable to be excited and also radiate when separately fed with a separate feed line to a feed point thereon.

19. An antenna as in claim 12 wherein a reflector is used behind one side thereof for reflecting the radiation from one of the twin radiating elements in the same direction as radiation from the other of the twin radiating elements thereby increasing the radiation signal from the antenna in one direction.

20. An antenna as in claim 12 wherein each of said radiating elements has a center conducting portion thereof removed and respective secondary radiating elements, smaller than the removed portions are disposed on each side of said dielectric substrate within the area of said removed portions and spaced from said radiating elements; said radiating elements and secondary radiating elements being disposed directly opposite to each other on opposite sides of said dielectric substrate; said smaller secondary radiating elements being operable to be excited and also radiate when coupled fed from the respective larger said radiating elements.

21. An antenna as in claim 12 wherein each of said radiating elements have a center conducting portion thereof removed and respective secondary radiating elements, smaller than the removed portions are disposed on each side of said dielectric substrate within the area of said removed portions and spaced from said radiating elements; said radiating elements and secondary radiating elements being disposed directly opposite to each other on opposite sides of said dielectric substrate; said smaller secondary radiating elements being operable to be excited and also radiate when secondarily fed from the respective larger said radiating element.

22. An antenna as in claim 12 wherein each of said radiating elements have a center conducting portion thereof removed and respective secondary radiating elements, smaller than the removed portions are disposed on each side of said dielectric substrate within the area of said removed portions and spaced from said radiating elements; said radiating elements and secondary radiating elements being disposed directly opposite to each other on opposite sides of said dielectric substrate; said smaller secondary elements being operable to be excited and also radiate when fed from a T-feed line along with the respective larger said radiating elements.

* * * * *